350-332 SR
PTH44 XR 3,975,726

United States Patent [19]
Kawakami

[11] 3,975,726
[45] Aug. 17, 1976

[54] METHOD AND DEVICE FOR DRIVING IN TIME DIVISION FASHION FIELD EFFECT MODE LIQUID CRYSTAL DISPLAY DEVICE FOR NUMERIC DISPLAY

[75] Inventor: Hideaki Kawakami, Hitachi, Japan

[73] Assignee: Hitachi, Ltd., Japan

[22] Filed: May 20, 1974

[21] Appl. No.: 471,602

[30] Foreign Application Priority Data

May 23, 1973 Japan ..... 56805/73

[52] U.S. Cl. ..... 340/336; 340/324 R; 350/160 LC

[51] Int. Cl.[2] ..... G08B 5/36

[58] Field of Search ..... 340/336, 378 R; 350/160 LC, 148, 158; 313/510, 513, 520; 358/59, 61

[56] References Cited

UNITED STATES PATENTS 3,711,180 1/1973 Klinger et al. ..... 358/61
3,758,195 9/1973 Hedman et al. ..... 350/160 LC
3,835,463 9/1974 Tsukamoto et al. ..... 340/324 M

*Primary Examiner*—David L. Trafton
*Attorney, Agent, or Firm*—Craig & Antonelli

[57] ABSTRACT

In a method and device for driving in time division fashion a field effect mode liquid crystal display device for numeric display, having a plurality of sets of segment electrodes, each set being provided for one digit, and a plurality of separated digit electrodes disposed opposite to the plurality of segment electrode sets respectively, the corresponding segment electrodes of the respective digits being commonly connected, the amplitude of voltages applied to the display points in the half-selected and non-selected states are kept constant while the effective value of the voltage applied to the display points in the selected state is arbitrarily set by changing the duty ratio of selection time so that color in the display may be changed.

8 Claims, 14 Drawing Figures

METHOD AND DEVICE FOR DRIVING IN TIME DIVISION FASHION FIELD EFFECT MODE LIQUID CRYSTAL DISPLAY DEVICE FOR NUMERIC DISPLAY

BACKGROUND OF THE INVENTION

1. Field of the Invention

The present invention relates to a method and a device for driving in time division (time sharing or multiplexing) fashion a field effect mode liquid crystal numerical display device, and more particularly, to a driving method and device by which color in a display can be changed.

2. Description of the Prior Art

It is a well-known fact that color in a display is changed if the effective value of the voltage applied to a field effect mode liquid crystal display device is changed.

In order to change the color in a display in a field effect mode liquid crystal numerical display device, the static driving method may be employed in which the voltage applied to the device is changed. With this method, however, there is a drawback that a very complicated driving circuit must be used to display a multi-digit number. On the other hand, in the case where the method of driving in time division fashion is used to simplify the driving circuit, there is a nuisance in that the brightness and the color in the display in the half-selected and the non-selected points are indefinite since the effective values of the voltages applied to those points fluctuate depending upon the pattern of the number to be displayed.

SUMMARY OF THE INVENTION

The object of the present invention is to provide a method and a device for driving in time division fashion a field effect mode liquid crystal numerical display device, by which the effective voltages applied to the half-selected and the non-selected points are kept constant for various patterns to be displayed so that the display may be in a predetermined color and by which the effective voltages applied to the selected points are arbitrarily changed by rendering the duty ratio of selection time variable so that the color in the display may be arbitrarily changed.

According to the present invention, in order to eliminate unevenness in brightness and color due to the mode of cross talk changing depending upon the displayed pattern in the time division fashion drive of a conventional field effect mode liquid crystal numerical display device, the influence of the displayed patterns upon the effective voltages applied to the selected, half-selected points is prevented. Namely, the time division fashion drive according to the cross talk voltage averaging method is used in which the amplitude of voltages applied to the display points in the half-selected and non-selected states is maintained at 1/N ($N \geqq 3$) of the amplitude of the voltage applied in the selected state. Consequently, the effective voltages applied to the half-selected and non-selected positions are made proportional to the voltages applied to the selected positions and kept constant while since the effective voltages vary in proportion to the voltages applied to the selected points and with the change in the duty ratio of selection time, the duty ratio is made variable to eliminate the unevenness in brightness and color and to arbitrarily change color and brightness in the display at the digit points selected.

DESCRIPTION OF PREFERED EMBODIMENTS

First, the principle and the structure of a field effect mode liquid crystal display device will be described in conjunction with FIGS. 1 to 4.

Figures 1A, 1B:
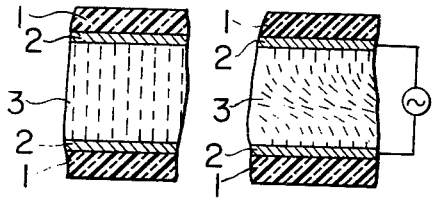
FIGS. 1*a* and 1*b* show examples of the states of molecular orientation in a liquid crystal element used in a field effect mode liquid crystal display device.

FIGS. 1*a* and 1*b* show how the molecules of the liquid crystal element of a field effect mode liquid crystal display device are oriented when the voltage applied to the element is controlled, FIG. 1*a* corresponding to the case where no voltage is applied to the element and FIG. 1*b* corresponding to the case where a voltage is applied to the element. In FIG. 1*a*, between a pair of Nesa glass plates consisting of glass plates 1 and transparent conductive films 2 coated thereon is filled liquid crystal to form a liquid crystal layer 3. The orientation of the molecules of the liquid crystal is perpendicular to the transparent conductive films 2 (hereafter referred to as electrodes) when no voltage is applied between the electrodes 2. If a voltage is applied between the electrodes 2, the orientation is changed as shown in FIG. 1*b*.

Figures 2A, 2B:
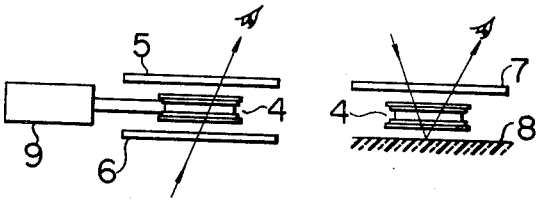
FIGS. 2*a* and 2*b* schematically show examples of the structure of a liquid crystal display device using such liquid crystal elements as shown in FIG. 1*a*.
Figure 3:
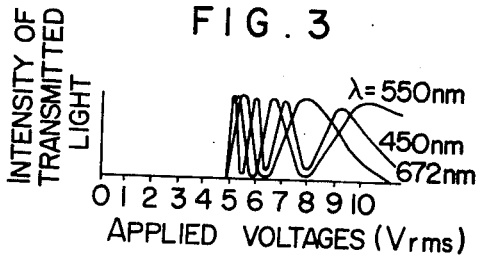
FIG. 3 shows in graphic representation the characteristic of the device as shown in FIGS. 2*a* and 2*b*.

FIGS. 2*a* and 2*b* show structures of field effect mode liquid crystal display devices using such a liquid crystal element as shown in FIG. 1, FIG. 2*a* corresponding to a transmission type element and FIG. 2*b* corresponding to a reflection type element. In FIGS. 2*a* and 2*b* are shown a liquid crystal element 4, polarizers 5 and 6 for linear polarization, a polarizer 7 for circular polarization, a reflector 8 and a driving signal source 9. In the transmission type element shown in FIG. 2*a*, the polarizers 5 and 6 are placed in orthogonal relation to each other and the liquid crystal element 4 as shown in FIG. 1 is placed between the polarizers 5 and 6. In the reflection type element shown in FIG. 2*b*, the liquid crystal element 4 is placed between the polarizer 7 and the reflector 8. If a voltage from the driving signal source 9 is applied between the electrodes 2 of the liquid crystal element 4 with white light projected upon the liquid crystal display device as indicated by arrows in FIG. 2*a* or 2*b*, the orientation of the molecules of the liquid crystal is changed to generate the color selectivity due to birefringence. FIG. 3 is a graphical representation of the relationship between the applied voltage and the intensity of transmitted light, with the wavelength of the projected light as a parameter. When the applied voltage is higher than 5 V, the peaks of the intensity appear periodically. Thus, the liquid crystal element remains dark till the applied voltage exceeds a certain value (5 V in FIG. 3) and as the voltage increases in excess of 5 V, the element is colored successively grey → white → orange → red → blue → green → red -----.

Figure 4:
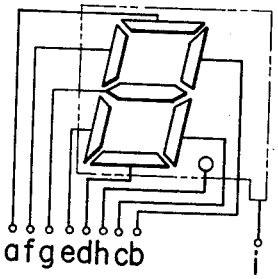
FIG. 4 shows the structure of a liquid crystal numerical display element.

FIG. 4 shows a structure of a liquid crystal numeric display element, in which one of the transparent conductive electrodes 2 (shown in FIG. 1) coated on the glass plates is formed in a 7-segment electrode, 1-decimal point electrode pattern. The display device using the element shown in FIG. 4 also has such a structure shown in FIG. 2*a* or 2*b*. With this structure, the color display as described above can be realized. In FIG. 4 are shown segment electrode terminals *a* to *g*, a decimal point electrode terminal *h* and a digit electrode terminal *i*, the digit electrode being formed of the other of the transparent conductive films 2 on the glass plate.

Figure 5:
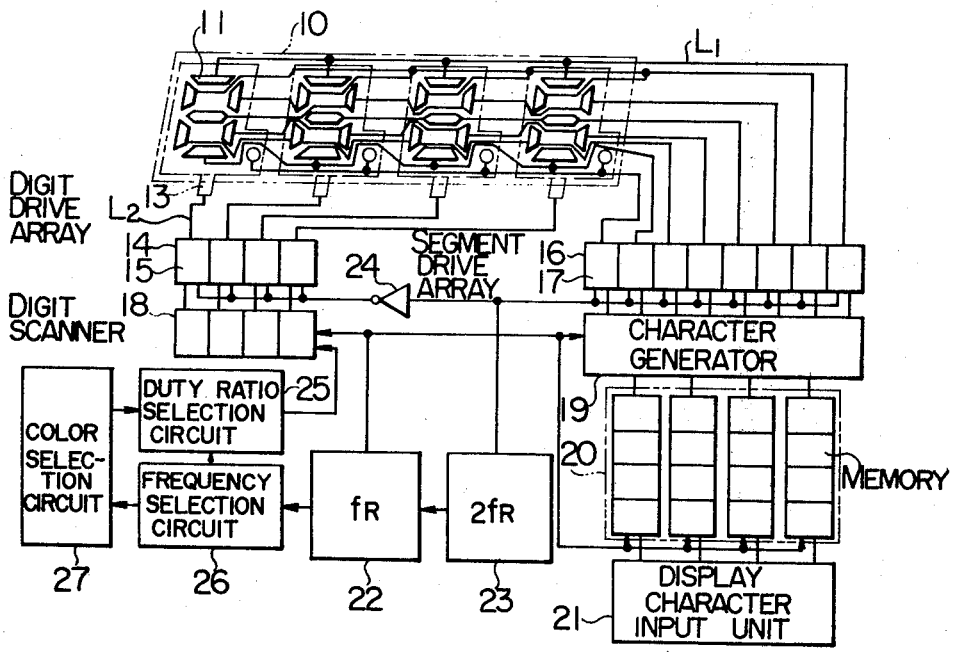
FIG. 5 shows in block diagram a driving means to drive a liquid crystal display device according to the present invention.

FIG. 5 shows an embodiment of the driving device of the present invention which is applied to a 7-segment electrode, 1-decimal point electrode type of liquid crystal numeric display device for 4 digits. Referring to FIG. 1, the liquid crystal numeric display device generally designated by the reference numeral 10 comprises seven segment electrodes 11 in each of four digit positions, and the corresponding segment electrodes 11 in the respective digit positions are connected in common in the device 10 in order to draw out seven segment electrode leads $L_1$. On the other hand, a digit electrode 13 is provided for each of the digit positions. These segment electrodes 11 and digit electrodes 13 are connected to respective segment driving circuits 17 and digit driving circuits 15 through the respective leads $L_1$ and $L_2$ to be driven by these driving circuits. These digit driving circuits 15 and segment driving circuits 17 are called herein a digit driving circuit array 14 and a segment driving circuit array 16 respectively.

A scanning signal is applied from a digit scanning circuit 18 which may be a ring counter to the digit driving circuit array 14, and a clock signal having a frequency of $2f_R$ is also applied to the digit driving circuit array 14 from a clock generator 23. The scanning frequency of the scanning signal is in synchronism with a frequency $f_R$ of a clock signal generated by another clock generator 22. On the other hand, an output signal of a character generating circuit 19 which may be a 7-segment decoder is applied to the segment driving circuit array 16 to which the clock signal is also applied from the clock generator 23.

An inverter 24 is provided to invert the phase of the clock signal applied to the digit driving circuit array 14 from the clock generator 23 so that the phase of the clock signal applied to the digit driving circuit array 14 is opposite to that of the clock signal applied to the segment driving circuit array 16. The output signal of the character generating circuit 19 is synchronous with the clock signal generated by the clock generator 22 so as to attain synchronization with the digit scanning. An input signal for deciding the character output of the character generating circuit 19 is applied from a memory means 20 which stores therein the characters to be displayed on the individual digit positions, and the output signal of the memory means 20 is synchronous with the clock signal generated by the clock generator 22 to attain synchronization with the digit scanning.

Thus, the displayed character information stored in the memory means 20 is converted into a driving signal for the liquid crystal numeric display device 10, and this driving signal is applied in time division fashion to the four digit positions of the liquid crystal numeric display device 10 to display the characters. The renewal of the displayed characters, that is, the renewal of the contents of the memory means 20 is carried out by a displayed character input unit 21 which may be connected to an arithmetic circuit in the case of an electronic desk-top calculator or computer and to a clock or timing circuit in the case of a clock or watch.

On the other hand, the selection of color in the display is performed by applying the signal of a color selection circuit 27 to a duty ratio selection circuit 25 so as to determine a duty ratio to select the digit drive array 15 by the digit scanner. In this case, the clock frequency is determined by the color selection circuit 27 and a frequency selection circuit 26 so that the frame frequency of the numeric display device is kept constant.

Figure 6:
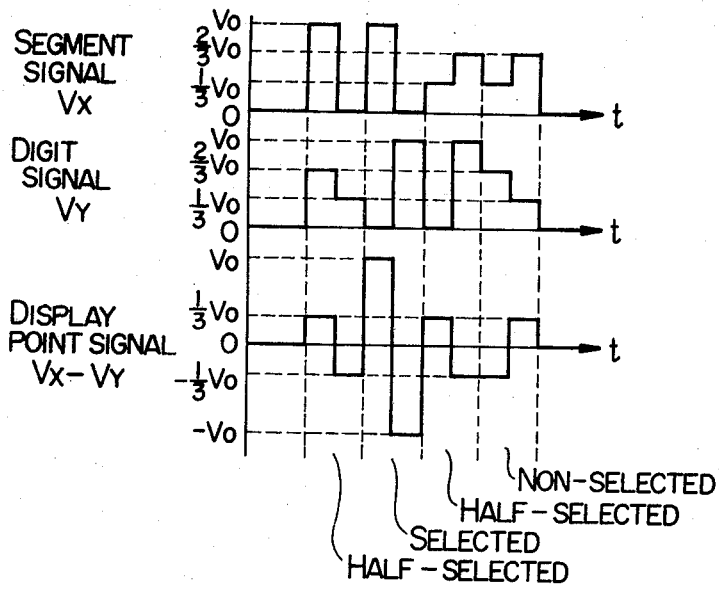
FIG. 6 shows examples of waveforms used in the driving method according to the present invention.

FIG. 6 shows examples of waveforms used to drive the numeric display device according to the present invention. This is the case where the amplitude of voltages applied to the points in the half-selected and the non-selected states are maintained at one third of the amplitude of the voltage applied to the points in the selected state.

In FIG. 6, the level of a segment signal $V_X$, a digit signal $V_Y$ and a display point signal $V_X - V_Y$ is variable depending on the selected state, half-selected state and non-selected state as shown. In FIG. 6, $V_O$ designates the voltage level which produces the scattering state of the liquid crystal. It will be seen that the segment signal $V_X$ is changed from $V_O$ to O during the selected state and from ⅓ $V_O$ to ⅔ $V_O$ during the non-selected state, while the digit signal $V_Y$ is changed from O to $V_O$ during the selected state and from ⅔ $V_O$ to ⅓$V_O$ during the non-selected state. As a result, the signal $V_X - V_Y$ applied to the display point is $\pm V_O$ in the selected state and $\pm V_O$ in the half-selected state. In the non-selected state, the phase of this signal is opposite to that in the half-selected state and the voltage of this signal is ± ⅓ VO.

The selected state denotes the state in which the digit electrodes and segment electrodes are simultaneously selected, the half-selected state denotes the state in which either the digit electrodes or the segment electrodes are only selected, and the non-selected state denotes the state in which none of the digit electrodes and segment electrodes are selected. Therefore, the liquid crystal (display point) between the digit electrode and the segment electrode which are placed in the selected state takes a scattering state, while it does not take the scattering state when these electrodes are placed in the half-selected or non-selected state. A voltage to the liquid crystal between the digit electrode and the segment electrode in the half-selected or non-selected state is generally called "cross talk voltage" and is maintained at ⅓ $V_O$ in FIG. 6.

Figure 7:
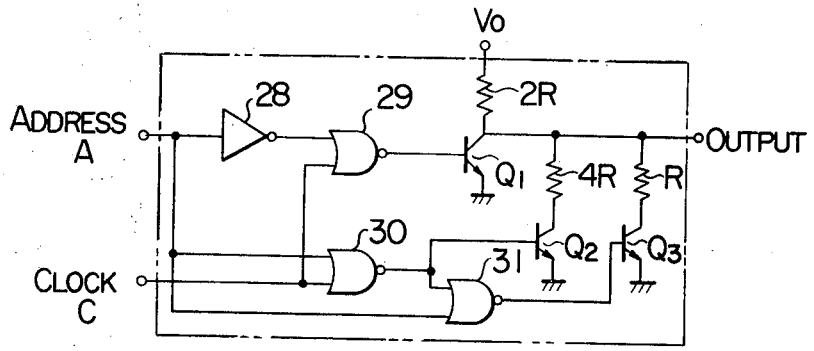
FIG. 7 shows an example of a concrete circuit to generate the waveforms shown in FIG. 6.

FIGS. 7 shows an example of practical structures of the driving circuits 15 and 17 shown in FIG. 5. Referring to FIG. 7, the driving circuit comprises three switching transistors $Q_1$, $Q_2$ and $Q_3$ resistors R, 2R and 4R, NOR gates 29, 30 and 31, and an inverter 28. The address signal A is applied to the inverter 28 and NOR gates 30 and 31, while the clock signal C is applied to the NOR gates 29 and 30.

Table I shows ON-OFF states of the switching transistors $Q_1$, $Q_2$, $Q_3$ and the output voltage relative to the address signal A and clock signal C applied to the driving circuit shown in FIG. 7.

Table I

| Address A | Clock C | ON-Transistor | Output |
|---|---|---|---|
| 0 | 0 | $Q_2$ | ⅔ $V_0$ |
| 0 | 1 | $Q_3$ | ⅓ $V_0$ |
| 1 | 0 | $Q_1$ | 0 |
| 1 | 1 | None | $V_0$ |

It will be apparent from Table I that any one of the desired output voltages ⅔ $V_O$, ⅓ $V_O$, O and $V_O$ can be obtained by a suitable combination of the address signal A and clock signal C.

Figure 8:
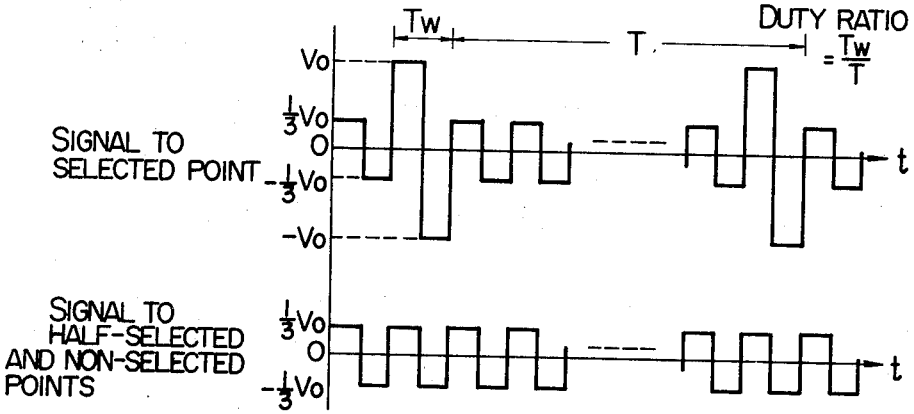
FIG. 8 shows examples of the waveforms of the signals applied to the selected points and the half-selected and non-selected points of the liquid crystal display device shown in FIG. 5.

FIG. 8, like FIG. 6, shows concrete examples of the waveforms of the voltages applied in operation to the selected point and the half-selected and non-selected points. In this case, the effective value VSI of the voltage applied to the selected point is given by $$VS1 = \sqrt{\frac{1}{N} V_0^2 + \frac{N-1}{N} \frac{V_0^2}{9}} = \frac{1}{3} \sqrt{\frac{N+8}{N}} V_0 \qquad 1.$$

Further the effective value VS2 of the voltage applied to the half-selected or non-selected point is given by $$VS2 = ⅓ V_O \qquad 2.$$

where N is the formulae (1) and (2) is such that N = T/Tw in FIG. 8. Since the duty ratio is usually given by Tw/T, it can be expressed as 1/N. Here Tw is the width of the selection pulse and T is the time interval of the successive selection pulses. It is apparent from the formulae (1) and (2) that the effective voltages VS1 and VS2 are not affected by the displayed pattern and that in virtue of the formula (1), the effective voltage VS1 of the selected point can be changed by changing the duty ratio.

Figure 9:
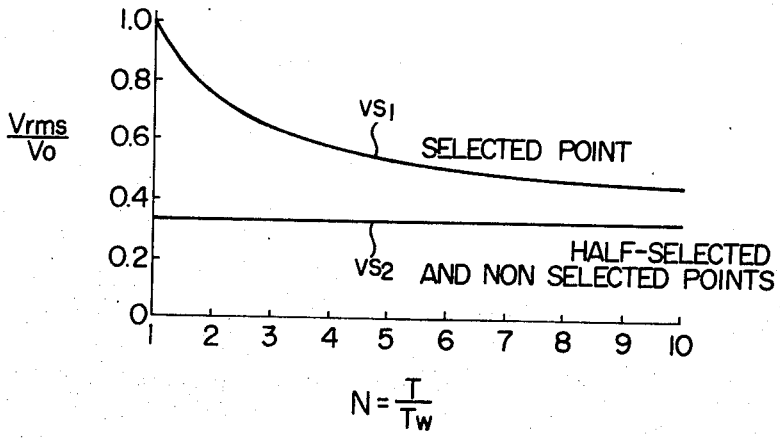
FIG. 9 shows the relationships between the duty ratio and the effective voltages.

FIG. 9 illustrates the change in the effective voltage VS1 applied to the selected point with respect to the change in the duty ratio and shows that the increase in N(N = T/Tw) is accompanied by the decrease in VS1 while the effective voltages of the half-selected and non-selected points remain constant. Accordingly, if $V_O$ is kept constant, the color in display at the half-selected and non-selected points is definite and if the duty ratio is changed by the duty ratio selection circuit 25 in FIG. 5, the color and the brightness of the displayed number can be freely selected.

Figure 10:
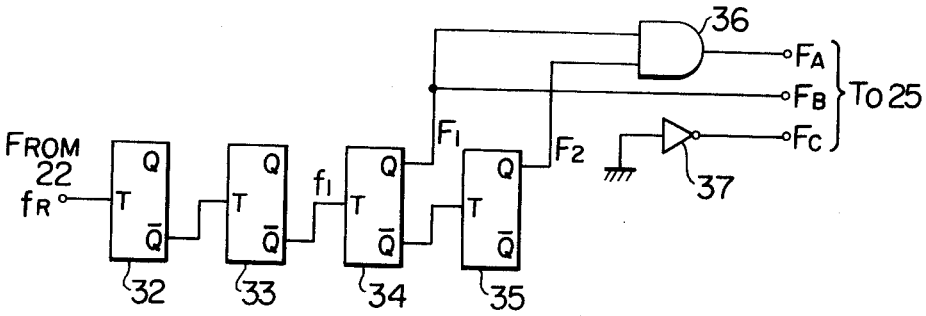
FIG. 10 shows a circuit diagram of an example of the frequency selection circuit in FIG. 5.
Figure 11:
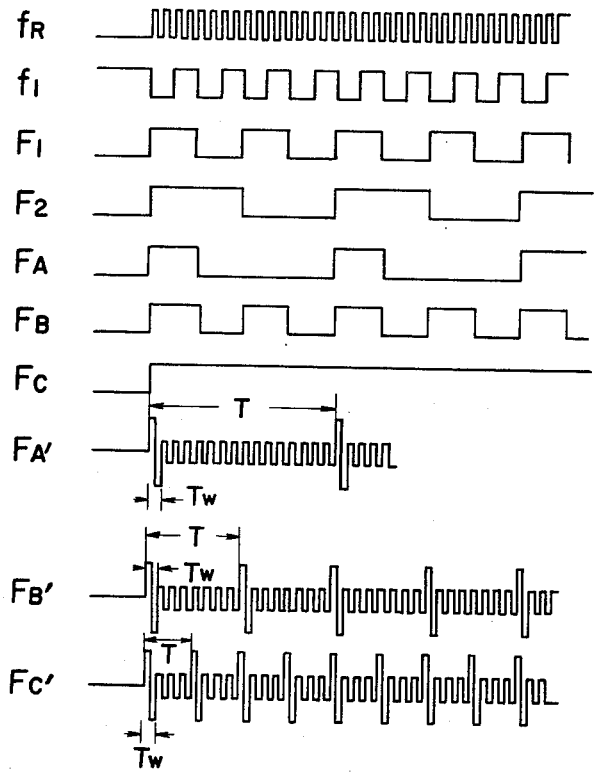
FIG. 11 shows waveforms at various parts of the circuit of FIG. 10.

FIG. 10 shows an example of the frequency selection circuit 26 in FIG. 5. The circuit comprises Flip-Flops 32 to 35, AND gate 36 and inverter 37. Waveforms of pulses at various parts of the circuit are shown in FIG. 11.

The clock frequency $f_R$ from the clock generator 22 is divided to ¼ through the Flip-Flops 32 and 33. By this signal $f_1$, signals $F_A$, $F_B$ and $F_C$ of duty ratio ¼, ½ and 1 are produced. The signal $f_1$ is used in forming waveforms $F_1$ and $F_2$ by the Flip-Flops 34 and 35 respectively. The AND output of $F_1$ and $F_2$ is obtained by the AND gate 36 to provide the signal $F_A$. The signal $F_C$ is obtained by the inverter 37 by which level "0" is always delivered as level "1".

Figure 12:
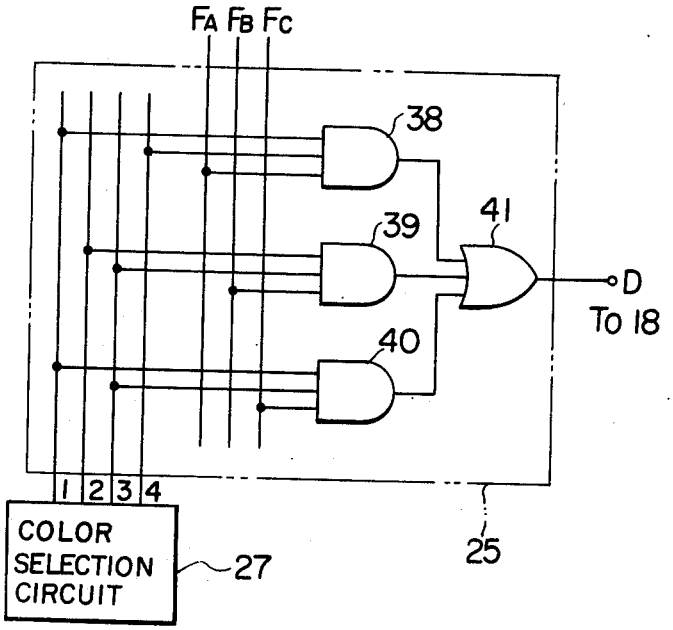
FIG. 12 shows a circuit diagram of an example of the duty ratio selection circuit in FIG. 5.

These signals $F_A$, $F_B$ and $F_C$ are applied to the duty ratio selection circuit 25 which is shown in FIG. 12 as an example. The circuit comprises AND gates 38 to 40 and OR gate 41. The color selection circuit 27 produces four-bit signals in response to input signals. The duty ratio selection circuit 25 selects one of the pulse signals $F_A$, $F_B$ and $F_C$ in response to the four-bit signals to determine the duty ratio of the output signal D. Thus, the output signal D represents one of the signals $F_A$, $F_B$ and $F_C$ of FIG. 11 and the duty ratio of the output signal D can be varied to one of ¼, ½ and 1.

The duty signal D and the clock signal $f_R$ are applied to the digit scanner 18. The digit scanner 18 produces a digit selection output for scanning only when the duty signal D is "1". For example, when the signal $F_A$ is selected, the signal to selected point of FIG. 8 is $F_A'$ of FIG. 11. When the signals $F_B$ and $F_C$ are selected, they are $F_B'$ and $F_C'$ respectively. The duty ratio Tw/T is 1/16, ⅛ and ¼ in the signals $F_A'$, $F_B'$ and $F_C'$ respectively. Thus, the duty ratio of the duty ratio selection circuit 25 is determined by the output of the color selection circuit 27 so that color in display is set in accordance with the duty ratio.

As described above, according to the present invention, the amplitude of voltages applied to the half-selected and non-selected points is maintained at one third of the amplitude of the voltage applied to the selected points and the effective value of the voltage applied to the selected points is freely determined by changing the duty ratio, so that the color of the half-selected and non-selected points can be maintained uniform while the color in the display of the selected points can be arbitrarily changed.

I claim:

1. A method of driving in time division fashion a field effect mode liquid crystal display device for numeric display, having a plurality of sets of segment electrodes, each set being provided for one digit, and a plurality of separated digit electrodes disposed opposite to the plurality of segment electrode sets respectively, the corresponding segment electrodes of the respective digits being commonly interconnected, said method comprising the steps of maintaining the amplitude of a.c. voltages applied to the display points in the half-selected and the non-selected states when the associated digit electrodes are not selected at a constant value, while controlling the effective value of a.c. voltages applied to the display points in the selected states by changing the duty ratio of the width of the selection pulse to the time interval of the successive selection pulses.

2. A method according to claim 1, wherein the highest voltage $V_0$ applied to said segment and digit electrodes is divided into three voltage levels $V_0$, $V_1$ and $V_2$ ($V_0 > V_1 > V_2 > 0$), and the divided voltages are suitably combined to apply a desired display point a voltage of $\pm V_0$ in the selected state and a voltage of about $\pm ⅓ V_0$ in the half-selected state and the non-selected state.

3. A method according to claim 1, wherein the step of changing the duty ratio changes the color of the display points in the selected state.

4. A device for driving in time division fashion a field effect mode liquid crystal display device for numeric display, having a plurality of sets of segment electrodes, each set being provided for one digit, and a plurality of separated digit electrodes disposed opposite to the plurality of segment electrode sets respectively, the corresponding segment electrodes of the respective digits being commonly interconnected, said device comprising a digit drive array for driving the respective digit electrodes, a digit scanner for scanning said digit drive array, a segment drive array for driving the respective segment electrodes, and a character generator for supplying a character signal to said segment drive array, the improvement comprising further a duty ratio selection circuit, whereby said digit scanner is controlled by the output of said duty ratio selection circuit to render the duty ratio variable.

5. A device according to claim 4, wherein the duty ratio selection circuit includes a plurality of AND gates each providing an output to an OR gate, the output of the OR gate determining the ratio for the digit scanner.

6. A device according to claim 5, further comprising a color selection circuit and a frequency selection circuit, each of the AND gates of the duty ratio selection circuit receiving at least one input from the color selection circuit and the frequency selection circuit.

7. A device according to claim 6, further comprising first clock generator means for supplying a first clock signal to the segment drive array and an inverted first clock signal to the digit drive array, and a second clock generator means for supplying a second clock signal to the frequency selection circuit, the digit scanner and the character generator, the second clock generator means being synchronized with the first clock generator means.

8. A device according to claim 7, wherein the first clock generator means provides a first clock signal having an output frequency of $2f$ and the second clock generator means is responsive to the first clock generator means for providing an output having a frequency $f$.

* * * * *